United States Patent [19]

Charniga

[11] 4,031,681

[45] June 28, 1977

[54] WALL CONSTRUCTION

[76] Inventor: Joseph Charniga, P.O. Box 5037, Poland, Ohio 44514

[22] Filed: Feb. 4, 1976

[21] Appl. No.: 655,266

[52] U.S. Cl. ..... 52/408; 52/553; 52/547; 52/481

[51] Int. Cl.[2] ..... E04B 2/02; E04C 2/80

[58] Field of Search ..... 52/518, 553, 547, 481, 52/620, 408, 409, 394

[56] References Cited

UNITED STATES PATENTS

| | | | |
|---|---|---|---|
| 255,595 | 3/1882 | Chase | 52/479 |
| 2,118,237 | 5/1938 | Slayter et al. | 52/481 |
| 2,324,971 | 7/1943 | Woodward | 52/481 |
| 2,541,762 | 2/1951 | Heritage | 52/481 |
| 3,124,847 | 3/1964 | Charniga | 52/481 |
| 3,173,229 | 3/1965 | Weber | 52/549 |
| 3,818,668 | 6/1974 | Charniga | 52/553 |

*Primary Examiner*—Price C. Faw, Jr.

*Assistant Examiner*—James L. Ridgill, Jr.

*Attorney, Agent, or Firm*—Webster B. Harpman

[57] ABSTRACT

A wall construction suitable for an exterior load bearing wall includes spaced studding positioned vertically between upper and lower plates with the outer surfaces of the studs scalloped so as to present limited areas of contact with an insulating board affixed thereto and preferably incorporating a moisture seal membrane. Siding or the like is positioned on the exterior of the insulating board to form the exterior surface of the wall and lath and plaster or dry wall is affixed to the interior surface of the studding in continuous contact therewith to complete the wall construction, the arrangement being such that the studding act as heat conveying fins on the lath and plaster or dry wall so as to warm the area within the wall construction. The spaced transversely positioned scallops in the exterior surface of the studding substantially isolating the studding from the insulating board and exterior siding.

4 Claims, 3 Drawing Figures

WALL CONSTRUCTION

BACKGROUND OF THE INVENTION

1. Field of the Invention

This invention relates to a wall construction such as used in frame building construction exterior walls and the like.

2. Description of the Prior Art

Prior wall structures have usually employed wooden studding with flat outer and inner surfaces and have located with the insulating board or sheathing and the lath and plaster or dry wall directly against the flat surfaces of the studding as seen in U.S. Pat. Nos. 2,482,918 and 3,318,056. The first of these patents utilizes insulation positioned in the cavities between the studding and the second provides grooved surfaces in the insulating board or sheathing and the constructions of both patents permit a relatively free heat transfer between the lath and plaster or dry wall on the interior of the studding and the insulating board or sheathing on the exterior of the studding. U.S. Pat. No. 2,118,237 provides minute transverse grooves in the interior and exterior surfaces of the studding and U.S. Pat. No. 2,410,922 attempts to space both the interior and exterior wall materials by forming outwardly facing dimples in the sides of metal studding against which the wall materials are positioned.

The present invention provides an exterior load bearing wall wherein the inner wall material, such as lath and plaster or dry wall, is supported in flat contact with the studding so as to enable heat from the interior lath and plaster or dry wall to move outwardly into the studding and heat the cavity in the wall defined between the studding. The transfer of the heat by the studding to the exterior insulated wall board or sheathing and siding is prevented by the contouring of the exterior surface of the studding through the formation of a plurality of closely spaced transverse scallops therein. The exterior insulating board and its siding therefore remain at exterior temperature and the inner lath and plaster or dry wall remain at room temperature with the cavities defined by the studding in the wall being warmed by the heat flow through the studding which act as heating fins therein.

SUMMARY OF THE INVENTION

A wall construction incorporating spaced vertical studding, the exterior surfaces of which are provided with a plurality of transverse shallow scallops in closely spaced relation to one another receives and isolates an exterior insulating board and siding or the like with a mininum of contact between the studding and the insulating board. The inner or opposite surfaces of the studding are flat and directly engaged against the lath and plaster or dry wall so as to conduct heat therefrom into the cavities between the studding so as to form a warm wall isolated from the exterior insulating board and siding thereon, by very limited contact therewith the insulating board being unbroken and forming a weather, air and moisture-tight exterior wall.

DESCRIPTION OF THE PREFERRED EMBODIMENT

Figure 1:
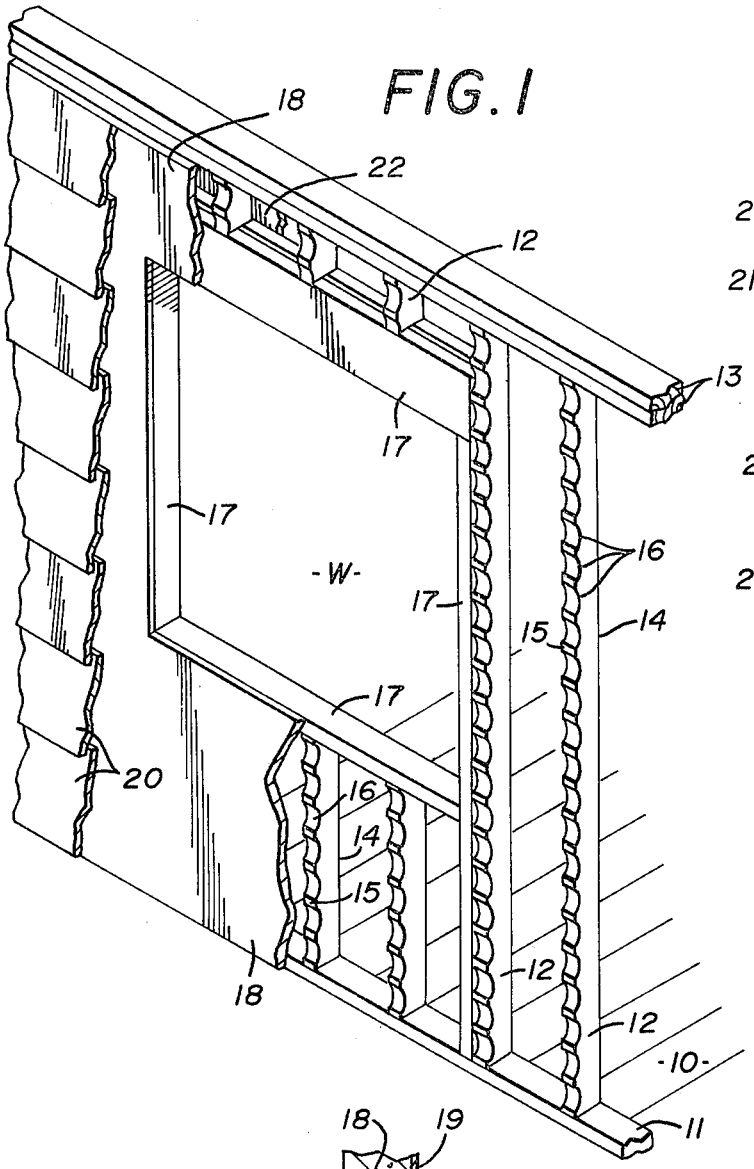
FIG. 1 is a perspective view of a portion of a wall construction formed in accordance with the invention.

By referring to the drawings and FIG. 1 in particular, it will be seen that a wall construction such as an exterior load bearing wall has been disclosed and wherein a sub-floor 10 or the like of a building is disclosed and supports a lower plate 11 with a plurality of studding 12 standing vertically thereon in spaced relation to one another and extending upwardly and receiving a doubled upper plate constuction 13 on their uppermost ends. Each of the studding 12 has a flat, inner surface 14 and a contoured exterior surface 15 formed by a plurality of closely spaced, transversly arranged shallow scallops 16, the lower plate 11, the doubled upper plates 13 and the studding 14 are formed of two by fours as known in the art and the inner and outer two inch surfaces of the lower plate 11 the doubled upper plates 13 are smooth and openings in the wall construction as for example a window opening W as seen in FIG. 1 is defined by smooth faced framing members 17. These framing members 17 are usually smooth faced studding in the vertical sides of the window opening W and the sill portion of the opening and are usually two by sixes or doubled two by fours briding the top of the window opening W.

Still referring to FIG. 1 of the drawings, it will be seen that the framing members 17 have smooth flat exterior surfaces just like the lower plate 11 and the doubled upper plate 13 so that relatively thick insulating board 18 preferably formed with a moisture-proof membrane 19 on its inner side may be sealed along its edges to the smooth flat surfaces of the lower plate 11, the framing members 17 about the opening W and the smooth flat surfaces of the double plate 13. An adhesive sealant which may be applied with a caulking gun or the like forms an effective seal as will be understood by those skilled in the art and they will recognize that the relatively thick insulating board 18 is secured to the narrow transverse flat surfaces between the scallops 16 of the studding 12 by fasteners such as nails.

Figure 2:
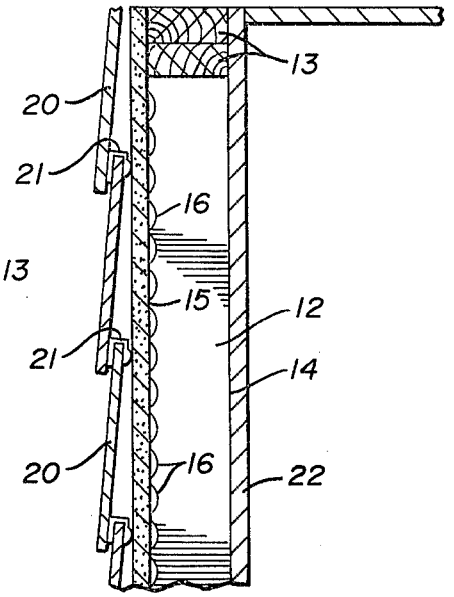
FIG. 2 is a vertical section on an enlarged scale through a wall construction incorporating the invention.
Figure 2:
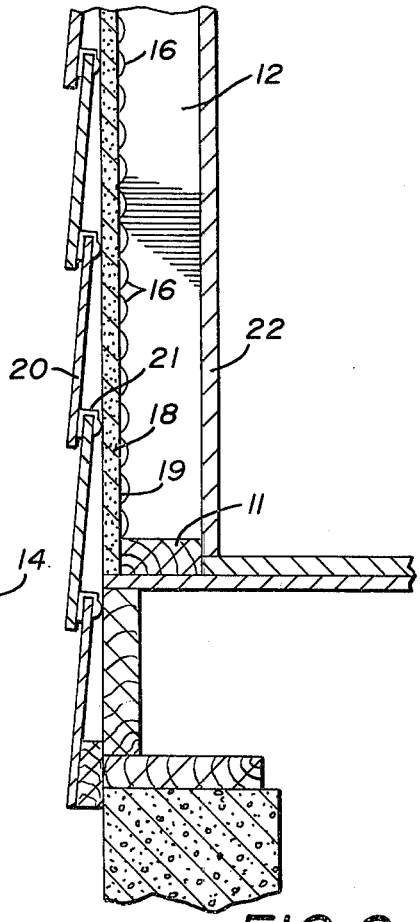
Figure 3:
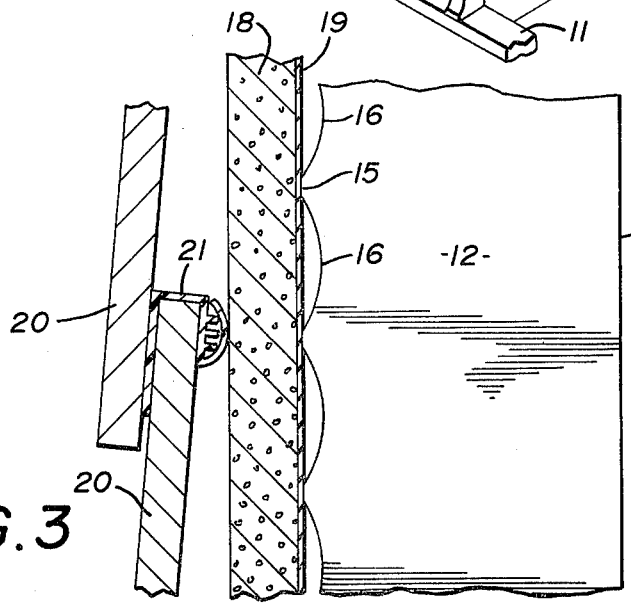
FIG. 3 is an enlarged detail of a portion of the exterior wall seen in FIG. 2.

By referring now to FIGS. 2 and 3 of the drawings, it will be seen that horizontally positioned lap siding 20 is shown affixed to the exterior of the relatively thick insulating board 18 with a siding mounting strip 21 formed of resilient plastic material in accordance with my U.S. Pat. No. 3,818,668 forming cushioned continuous closures between the overlapping siding 20 and the exterior of the relatively thick insulating board 18. The siding 20 is attached to the wall by fasteners such as nails preferably engaged through the overlapping portions of the siding 20 so as to engage the insulating board 18 and the studding 12. The construction forms a plurality of horizontally extending vertically spaced air pockets between the interior of the siding 20 and the exterior of the relatively thick insulating board 18 and results in an efficient weather resisting water-tight exterior wall having only very limited engagement with the contoured surface of the studding on which it is supported.

In FIG. 2 of the drawings the inner surfaces of the studding 12 which are smooth and flat will be seen to directly support a lath and plaster or dry wall 22 and that the same extends from the lower plate 11 to the doubled upper plate 13 and is engaged thereagainst.

Still referring to FIG. 2 of the drawings, it will be seen that the temperature of the lath and plaster or dry wall 22 will generally conform with that of the room partially defined thereby in the building construction in which the invention is used. It will also be seen that this temperature will be conveyed by contact into the studding 12 and be dissipated from the larger sides of the studding 12 into the cavities defined therebetween so that a warm wall interior results. There is little or no travel of moisture from the inner warm wall into the interior of the wall because it is all at substantially the same temperature and the present invention therefore primarily relates to the formation of an exterior bearing wall construction which is in internally warmed and which forms a weather and temperature barrier from the exterior thereof by reason of the siding 20, the air spaces therebeneath and the relatively thick insulating board 18 and the moisture barrier membrane 19 thereon all of which is in very limited contact with the studding 12 by reason of the plurality of scallops 16 formed in the exterior surfaces thereof.

Although but one embodiment of the present invention has been illustrated and described it will be apparent to those skilled in the art that various changes and modifications may be made therein without departing from the spirit of the invention and having thus described my invention what I claim is:

1. An exterior load bearing wall construction comprising an inner wall portion, studding supporting said inner wall portion in continuous contact therewith, a plurality of closely spaced scallops formed in the outer surfaces of each of said studding so as to form narrow transverse areas therebetween, an outer wall portion positioned against said narrow transverse areas of said studding and secured thereto in limited contact therewith and exterior surfacing material on said outer wall portion, said inner wall portion comprising dry wall or the like and said outer wall portion comprising insulating board and siding or the like, upper and lower plates positioned on the upper and lower ends of said studding, the outer surfaces of said plates being smooth, said insulating board of said outer wall portion being positioned against said smooth surfaces of said plates in substantially weather-tight relation.

2. The wall construction set forth in claim 1 and wherein the insulating board of said outer wall portion is unbroken and a waterproof membrane is positioned between the inner surface of said insulating board and the narrow transverse areas of said studding.

3. The wall construction set forth in claim 1 and wherein framing members define an opening in said wall construction, the outer surfaces of said framing members being smooth and unbroken and wherein said insulating board of said outer wall portion is positioned against said smooth and unbroken surfaces of said framing members defining said opening in substantially weather tight relation.

4. The wall construction set forth in claim 1 and wherein said inner wall portion is secured to the inner surfaces of said studding in continuous heat conducting relation thereto whereby the studding act as fins in said wall construction and are substantially separated from said outer wall portion by said scallops.

* * * * *